United States Patent [19]

LaGrange et al.

[11] Patent Number: 4,806,083

[45] Date of Patent: Feb. 21, 1989

[54] SUBMERSIBLE PUMP WITH EXPANDED FOAM HOUSING

[75] Inventors: Nyle D. LaGrange; Darryl M. Nielsen, both of Lenexa; Terry A. Peterson, Linwood, all of Kans.

[73] Assignee: The Marley-Wylain Company, Mission, Kans.

[21] Appl. No.: 921,315

[22] Filed: Oct. 21, 1986

[51] Int. Cl.[4] ..... F04B 17/00; F04B 35/04

[52] U.S. Cl. ..... 417/423.14; 417/424.1; 417/DIG. 1; 310/89; 264/272.2

[58] Field of Search ..... 417/423 T, 424 R, 423 G, 417/423 H, DIG. 1; 310/43, 89; 264/46.4, 272.2, 272.19

[56] References Cited

U.S. PATENT DOCUMENTS

| | | | |
|---|---|---|---|
| 2,777,963 | 1/1957 | Kuntz | 310/43 |
| 2,782,720 | 2/1957 | Dochterman | 310/43 |
| 3,119,342 | 1/1964 | White | 417/423 T |
| 3,200,273 | 8/1965 | Lindt et al. | 310/43 |
| 3,748,066 | 7/1973 | Sully et al. | 415/121 G |
| 4,036,257 | 7/1977 | Hanson et al. | 137/615 |
| 4,218,196 | 8/1980 | Ohnishi | 417/423 G |

FOREIGN PATENT DOCUMENTS

| | | | |
|---|---|---|---|
| 2307920 | 9/1973 | Fed. Rep. of Germany | 417/423 R |
| 309671 | 7/1933 | Italy | 417/424 |
| 76614 | 6/1977 | Japan | 310/89 |
| 823781 | 11/1959 | United Kingdom | 264/272.2 |
| 1238835 | 7/1971 | United Kingdom | 417/424 |

*Primary Examiner*—Donald E. Stout

*Attorney, Agent, or Firm*—Hovey, Williams, Timmons & Collins

[57] ABSTRACT

An expanded foam material surrounds a relatively thin, metallic motor casing and forms a housing which supports the motor while providing a seal to preclude leakage of liquids into the motor casing and to prevent discharge of dielectric oil from the interior of the motor casing. During manufacture of the pump, the casing is placed within a mold and a portion of the mold structure complementally and firmly engages four radially spaced regions of the generally cylindrical motor casing. Next, a quantity of the initially pourable foam material is introduced into the space between the mold and the casing, and the material self-expands to a solidified, cured condition in firm, surrounding engagement with the motor casing. The mold structure engaging the four regions of the casing consequently causes four radially spaced openings or windows to be formed which extend through the cured housing and expose the associated regions of the casing to the atmosphere, so that dissipation of heat from the motor is facilitated during operation of the pump. Curing of the foam material occurs at a relatively low temperature and pressure so that the housing may be molded around the casing in direct contact with the same without damage to the internal motor components.

7 Claims, 1 Drawing Sheet

SUBMERSIBLE PUMP WITH EXPANDED FOAM HOUSING

BACKGROUND OF THE INVENTION

1. Field of the Invention

This invention relates to pumps of the type known as sump pumps and utility pumps and concerns an expanded foam housing in combination with a relatively thin, metallic motor casing around which the housing is molded. The housing is of sufficient density and strength to support the motor and includes walls defining an integrally molded handle, volute and discharge passageway. Four radially oriented openings or windows in the housing expose portions of the metallic motor casing to enable the casing and thereby the motor to be cooled during operation of the pump.

2. Description of the Prior Art

Over the years, the popularity of small, portable pumps has increased as new and different uses for such pumps are brought to light. Pumps generally classified as utility pumps can be used, for example, in temporary locations for draining swimming pool covers, boats, and flooded basements. Sump pumps, on the other hand, are often very similar to utility pumps except that sump pumps are normally permanently located in a basin or sump and are provided with sensors or switches which automatically activate and deactivate the pump in accordance with the level of water. Additionally, the water inlet for sump pumps is often spaced a distance above the bottom of the pump housing to inhibit dirt and debris in the sump from being forced through the pump, while the inlet for utility pumps is somewhat lower and nomally located at the bottom of the housing so that a maximum of water can be extracted and drained from the location of use.

One type of submersible pump is disclosed in U.S. Pat. No. 3,748,066, dated July 24, 1973 and owned by the assignee of the present invention. The pump shown in U.S. Pat. No. 3,748,066 has an inner motor housing surrounding a motor and containing a quantity of dielectric oil, an outer jacket or housing which surrounds the motor housing, a motor dome to cover the motor and contain the oil, a base member having walls defining a volute and discharge passageway as well as a number of O-rings and seals which are used to preclude leakage and/or intermixing of the dielectric oil and liquids to be pumped.

While the pump disclosed in U.S. Pat. No. 3,748,066 represents a significant advance in the art for reasons which are not significant to an understanding of the present invention, there is nevertheless a need to reduce the time and expense necessary to build the pump components and assemble the same without adversely affecting the durability and longevity of the pump, especially considering the fact that utility pumps, for instance, can be moved frequently from place to place and used in hostile environments. Pumps constructed in similar fashion to the pump shown in U.S. Pat. No. 3,748,066 typically have as many as 30 to 40 separate components that are assembled by hand and as a consequence great reliance is placed upon the seals and O-rings for keeping the dielectric oil and pumped liquids in their respective places.

Oftentimes, a number of the pump housing components including the motor housing, motor dome, outer jacket and base member are comprised of a synthetic resinous material that is manufactured by an injection mold process. However, injection molding is a complex technology and requires use of heating coils in the mold to initially maintain the synthetic resinous material in a flowable condition for filling the mold. Cooling coils are also necessary in order to rapidly dissipate heat from the synthetic resinous material once the same is in place and the heating coils are deactivated. Various areas of the mold defining cavities and wall sections of different thicknesses require highly engineered and precisely positioned heating and cooling coils so that proper heat introduction, distribution and subsequent dissipation is ensured.

The electrical wires forming the windings in motors are typically insulated with a thin varnish type of material that is damaged when subjected to temperatures above, for example, 125° Centigrade. As a consequence, it is not practical to form an injection-molded jacket for the pump directly around the motor in an attempt to reduce the time required for assembly, since injection molding processes are normally carried out at temperatures ranging from 200°-250° Centigrade. Also, the plastic material is introduced into such molds by means of screw augers or the like under pressures which are of a value sufficient to injure certain components of the motor assembly and to cause a portion of the synthetic resinous material to enter the motor bearings and areas between the rotor and stator.

SUMMARY OF THE INVENTION

In accordance with the teachings of the present invention, a relatively thin, metallic casing encloses a pump motor and a quantity of self-expanding, microcellular foam material is molded around the casing in direct contact with the same. The foam material, optionally comprised of polyurethane, is sufficiently dense for structurally supporting the remaining pump components and forms a tough outer skin which resists damage due to accidental impact of the pump against hard surfaces and sharp objects.

During manufacture of the pump, the metallic motor casing is placed within a mold and four mold structural members are brought into firm, complemental engagement with spaced, corresponding regions of the outer surface of the motor casing. After the initially flowable synthetic resinous material is introduced into the mold cavities in spaces between the mold and remaining regions of the motor casing, the material is cured to a solidified condition and the foam housing now supporting the motor is removed from the mold. As a result, four radially oriented openings in the cured foam housing are thereby presented to thereafter expose four regions of the metallic motor casing so that heat generated by the motor during operation of the pump can be readily dissipated. The four openings or windows are large enough to enable the motor to be cooled regardless of whether the pump is submerged and water is in contact with the casing, or alternatively whether the level of water is below the openings and the casing is exposed to the air.

The one-piece foam housing has walls defining a volute chamber and discharge passageway as well as walls defining an upper handle for carrying the pump. Furthermore, during curing of the foam material, a portion of the expanding foam enters a flared joint between a top member and a bottom member forming the motor casing to thereafter form and provide a seal for the joint to substantially preclude leakage of dielectric oil that is later introduced into the casing. Once the solidified, cured foam housing is removed from the mold, the only steps necessary for completion of the pump assembly are installion of an impeller on the motor shaft, mounting of a cover plate and strainer to the bottom of the housing, and filling the casing with dielectric oil.

DETAILED DESCRIPTION OF THE DRAWINGS

Figure 1:
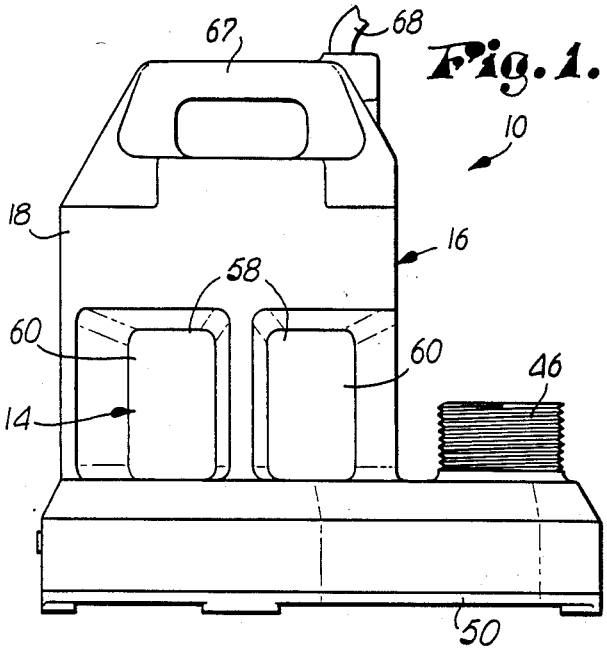
FIG. 1 is a side elevational view of the submersible pump of the present invention illustrating the expanded foam housing and two openings formed in the housing which expose an inner metallic motor casing.

In accordance with the present invention, a submersible pump broadly designated 10 in FIGS. 1–5 includes an electric motor 12, a casing 14 enclosing the motor 12, and a housing 16 comprising a quantity of initially pourable, cured foam material 18 surrounding the casing 14. The cured synthetic resinous material 18 is self-expanding while curing to an expanded state, and the material 18 in its solidified condition is of sufficient strength to securely support the motor 12 and casing 14 during operation of pump 10.

Figure 4:
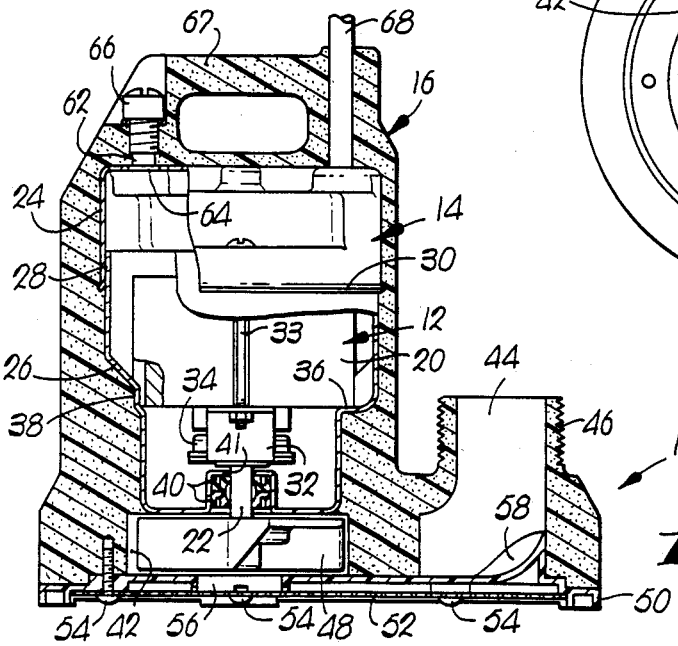
FIG. 4 is a side cross-sectional view taken along line 4—4 of FIG. 2, with regions of a top member and a bottom member forming the motor casing cut away in section to reveal components of the motor.

The motor 12, as illustrated in FIG. 4, includes a lamination stack 20 comprising an aligned series of individual, ring-like laminations through which extends a motor armature having an upright armature shaft 22. Windings (not shown) pass through channels in the lamination stack 20 and include looped end portions disposed above and below stack 20 spaced radially around the longitudinal axis of upright shaft 22.

Motor casing 14, comprised of a thin metallic material such as stainless steel, includes an upper member 24 and a lower casing member 26 coupled to the upper member 24 at a joint 28. As shown in FIG. 4, the lower edge of upper casing member 24 is flared outwardly at 30 in the vicinity of joint 28 for ease of assembly.

Lamination stack 20 is secured to the upper casing member 24 by means of bolts such as bolt 33 that extends from a recess of upper member 24, through a notched passage in lamination stack 20 and to the lower surface of a bracket 32 that supports an armature shaft bearing 34. The lower casing member 26, in turn, presents a shoulder 36 which supports the bottom of the lamination stack 20. The lower casing member 26 also has two inwardly formed segments 38 on opposite sides of the stack 20 which fit within a respective one of two vertical slots formed in the outer edge of the stack 20.

Desirably, the outer diameter of the upper portion of the lower casing member 26 is slightly larger than the inner diameter of the lower portion of the upper casing member 24 so that an interference fit at joint 28 is presented to facilitate assembly of the casing 14. Shoulder 36, in cooperation with the interference fit presented at joint 28 as well as the inwardly directed segments 38 that nestle in the vertical slots of lamination stack 20, facilitates alignment of the lower casing member 26 to the upper casing member 24 as well as to the lamination stack 20 and the armature shaft 22. That is, because the lamination stack 20 is securely coupled to the upper casing member 24 by bolts 33, and since bearing 34 is fixed to bracket 32, the lower casing member 26 may be readily brought into proper vertical as well as horizontal alignment with stack 20 and armature shaft 22 as soon as the shoulder 36 which extends around the majority of the inner perimeter of lower casing member 26 is brought into firm engagement with the underside of stack 20.

A lower, central portion of lower casing member 26 is formed upwardly to present a cylindrical seal cavity which houses two lip seals 40. Armature shaft 22 extends through an aperture 41 in the lower casing member 26 to pass through the middle of lip seals 40. Thus, the alignment of lower casing member 26 to lamination stack 20 by virtue of joint 28, shoulder 36, and inwardly directed segments 38 insures that the shaft 22 will be retained at the center of the lip seal cavity and not exert lateral pressure on either of the lip seals 40.

The foam material 18 of the housing 16 has walls defining a volute cavity 42 immediately below the lower casing member 26. As can be appreciated by reference to FIGS. 4 and 5, the volute cavity 42 is somewhat cylindrical and communicates with a discharge passageway 44. The foam material 18 is also formed to present threads 46 for coupling to a hose or other fitting as may be desired to direct liquids toward a location away from pump 10. An impeller 48 is fixed to a lower end portion of the armature shaft 22 and rotates within volute cavity 42 to force liquids through the discharge passageway 44.

Figure 3:
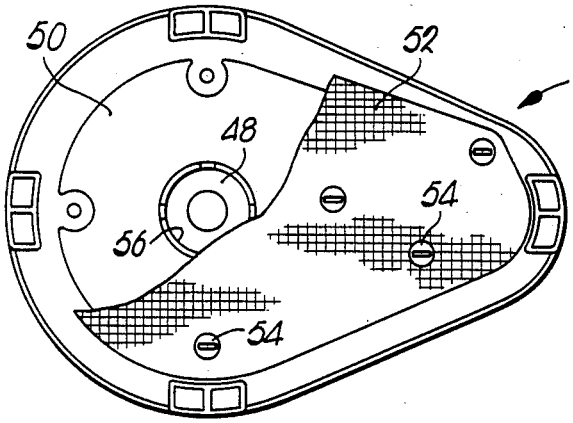
FIG. 3 is a bottom view of the pump depicted in FIG. 1 with a portion of a bottom strainer cut away to reveal areas of a volute cover plate.
Figure 5:
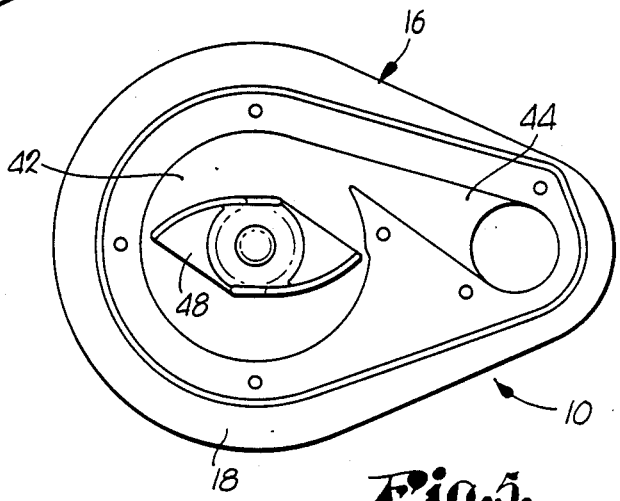
FIG. 5 is a view somewhat similar to FIG. 3 but with the strainer and cover plate removed to reveal a volute and discharge passageway integrally formed by portions of the expanded foam housing, and showing also an impeller centered in the volute.

Viewing FIGS. 3 and 4, a volute cover plate 50 and a underlying strainer 52 are affixed to the foam housing 16 by means of screws 54. The volute cover plate 50 presents a circular port 56 which admits liquids passing through strainer 52 into volute cavity 42. The cover plate 50 also has a curved surface 58 (See FIG. 4) which guides liquids pumped from the liquid cavity through an upward, 90° turn in the discharge passageway 44.

METHOD OF ASSEMBLY

During construction of the pump 10, the motor 12 is enclosed within casing 14 as previously indicated by assembling the lower casing member 26 to the upper casing member 24 until shoulder 36 lodges against the lower surface of lamination stack 20. Next, the casing 14 with the enclosed motor 12 is placed within a mold that has structure for engaging the bottom of lower casing member 26.

The mold, which is preferably of a hinged type, has structure which is complemental in configuration to four outer regions 58 of the casing 14. The mold support structure is then brought into firm engagement with the casing regions 58 once the mold is closed about its hinges.

Next, the initially flowable synthetic resinous material 18 is introduced into spaces between the mold and remaining regions of the casing 14 apart from regions 58. The material 18 is then cured to a solidified condition as the material 18 self-expands to substantially fill the spaces between the mold and the remaining regions of the casing 14. As a result, the material 18 generally surrounds the casing 14 for thereafter supporting the same.

Next, the mold is opened and the mold structure engaging the casing regions 58 is pulled away from casing 14 so that four radially spaced openings 60 are presented which extended through the material 18 and expose the regions 58. Thereafter, the four openings 60 function to cool the motor 12 during operation of pump 10, and such cooling is desirable in view of the fact that the foam material 18 has a relatively high thermal resistance by nature. The self-expanding nature of the foam material 18 ensures that the latter properly kisses the casing 14 around the perimeter of each opening 60 and firmly engages the same, so that entry of liquids to areas between the housing 16 and remaining regions of casing 14 is substantially precluded.

A quantity of dielectric oil is introduced into the casing 14 through a passage 62 in the housing 16 and a hole 64 in the upper casing member 24, and the passage 62 is thereafter sealed by means of a screw 66. During the introduction and curing of the foam material 18, a portion of the latter creeps upwardly into the joint 28 which is located above the opening 60, and the foam material 18 expands to a solidified condition to seal the joint 28 and to thereafter substantially prevent escape of dielectric oil without the use of O-rings or gaskets which would otherwise be necessary.

Polyurethane foams are commonly prepared by reacting an isocyanate with a hydrogen-containing compound having a reactive hydroxyl group. The reaction occurs in the presence of a catalyst and a blowing agent such as Freon® is provided in order to produce an expanded, cellular product. In the case of the present invention, the use of Freon® is desirable in order to ensure that the foam material 18 forms a thick, tough outer skin that is resistant to damage by impact and the like. However, water may be combined with the Freon® to keep the overall density of the foam material to a minimum in order to correspondingly reduce costs of the overall product. One suitable microcellular foam for manufacture of pump 10 is commercially available from Renosol Corporation and is identified as System No. RU-6014-K.

Preferably, when the housing 16 is formed from a polyurethane material, the average molded density of the polyurethane is less than approximately 0.9 grams per cubic centimeter. Better results have been obtained, however, when the average molded density of the polyurethane material 18 is in the range of from approximately 0.3 grams per cubic centimeter to approximately 0.5 grams per cubic centimeter. Best results have been observed when the average molded density (or specific gravity) of the foam material 18 is in the range of from approximately 0.4 grams per cubic centimeter to approximately 0.45 grams per cubic centimeter. The preferred density ranges for the foam material 18 enable the housing 16 to have sufficient structural strength for resisting damage that might otherwise occur during rough handling or accidental jarring of the pump 10, without adversely adding necessary weight or cost of the pump 10. For instance, when the average molded density of the polyurethane material 18 is 0.4 grams per cubic centimeter, the notched IZOD impact strength is 3.5 ft lb/in, a value which has been found to provide superior results.

All exterior wall surfaces of the housing 16, including walls adjacent the openings 60, screw 66 and an integral handle 67, are preferably sloped to prevent pooling of water when the water level falls and to prevent capture of air bubbles when the pump 10 is submerged. Moreover, the foam material 18 is somewhat resilient and thereby dampens vibrations caused by operation of motor 12.

Curing of the self-expanding foam material 18 occurs at a temperature that does not adversely affect the varnish insulation of the windings of motor 12. As a consequence, it is therefore possible by practice of the present invention to use the outer surface of the casing 14 as part of the mold and to directly mold the foam material 18 to the casing 14 without fear of thermal damage to the windings. Moreover, during the process of introducing and curing the foam material 18 in the mold, the pressure exerted by the expanding foam material 18 is not sufficient to crush or otherwise injure regions of the casing 14.

The density of the foam material 18 may be varied during formation of the housing 16 by pouring the foam material 18 in areas of the mold cavity where greater densities are desired. In this respect, for instance, the foam in its initially flowable condition can be directed toward the areas of the mold which form the threads 46, so that the latter when cured are of a strength sufficient for direct coupling to a fitting without shearing or tearing of the material 18.

Figure 2:
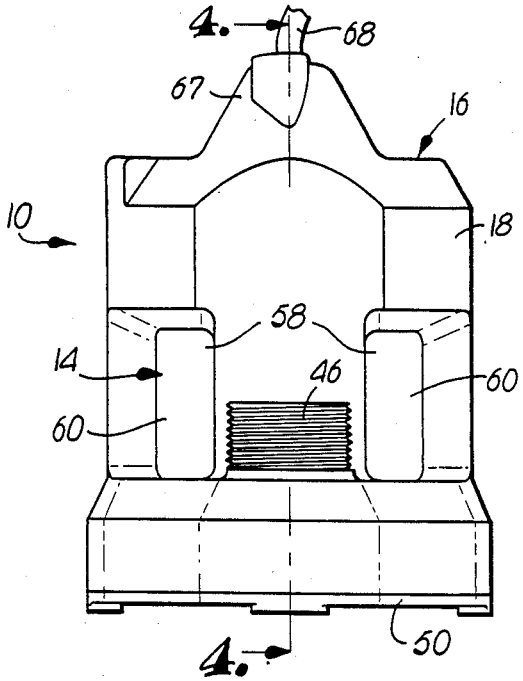
FIG. 2 is an end elevational view of the pump shown in FIG. 1.

During assembly of the pump 10, a portion of the foam material 18 surrounds a portion of a synthetic rubber power cord 68 as illustrated in FIGS. 1, 2 and 4. However, because synthetic rubber may creep over an extended period of time, it is desirable before molding to first install an O-ring on the power cord between two plastic tie wraps. The tie wraps (not shown) tightly grip the power cord 68 to reduce the likelihood of creep, and the foam material 18 will rigidly adhere to both sides of the O-ring (also not shown) in order to substantially prevent leakage of fluid along passageways between the housing 16 and the length of the power cord 68.

As can now be appreciated, use of the expanding foam material 18 in combination with the thin, metallic casing 14 permits efficient and fast manufacture of the pump 10. In addition, the number of seals normally encountered with prior art pumps, including gaskets, O-rings and the like is significantly reduced due in part to the fact that the housing 16 is a one-piece molded product that covers generally the entire casing 14 including the single joint 28 connecting the two casing members 24, 26. Moreover, the process of molding the foam material 18 to directly surround and engage the casing 14 avoids the necessity of assembling by hand a number of motor housing components typically utilized with conventional pumps whereby associated labor costs and expenses for materials can be drastically reduced.

We claim:

1. A submersible pump comprising:

a hollow metallic casing including a continuous metallic sidewall, a metallic top wall and a metallic bottom wall cooperating to define an enclosed internal chamber;

an electric motor received within said chamber and having a rotatable armature shaft projecting through said bottom wall;

an impeller fixed to said armature shaft below said bottom wall of the casing for rotation with the shaft when electrical power is supplied to the motor; and a microcellular, expanded foam housing of initially flowable, cured synthetic resinous material around the exterior only of said casing in surrounding relationship therewith.

said housing comprising an integral body of said material adhered tightly to said sidewall and said top wall in firm, rigid, face-to-face, contacting engagement therewith, said casing extending substantially around the periphery of said motor and being normally substantially free of openings for generally precluding contact of said material with said motor, said housing including a portion extending downwardly beyond said bottom wall and configured to present a volute cavity which receives said impeller, a fluid inlet leading into said cavity and a fluid discharge passage leading out of said cavity.

2. The invention of claim 1, wherein said casing includes an upper member having a peripheral edge portion and a lower member having a peripheral edge section coupled to said upper member edge portion at a joint, said synthetic resinous material covering said joint and being in flat, rigid, face-to-face engagement with both of said edge portion and said edge section along substantially the entire peripheral extent thereof on each side of said joint for generally preventing entry of liquids into said casing in the vicinity of said motor.

3. The invention of claim 1, wherein said synthetic resinous material consists essentially of polyurethane molded to an average density of less than approximately 0.9 grams per cubic centimeter.

4. The invention of claim 3, wherein said average molded density of said polyurethane is in the range of from approximately 0.3 grams per cubic centimeter to approximately 0.5 grams per cubic centimeter.

5. The invention of claim 4, wherein said average molded density of said polyurethane is in the range of from approximately 0.4 grams per cubic centimeter to approximately 0.45 grams per cubic centimeter.

6. In combination:

an electric motor;

a casing enclosing said motor; and a housing comprising a quantity of initially flowable, cured synthetic resinous material surrounding said casing, said material in said solidified condition being a foam expanded to a configuration for securely contacting a substantial portion of said casing and supporting the same, said casing extending substantially around the periphery of said motor for generally precluding contact of said material with said motor, said housing having walls defining at least one opening extending through said material exposing the remaining portions of said casing for enabling cooling of said casing and thereby of said motor during operation of the latter, wherein said walls of said material defining said at least one opening are in close, rigid engagement with said casing around the entire periphery of said opening for establishing a leak resistant seal to substantially preclude the entry of liquid in areas between said casing and said material.

7. In combination:

an electric motor;

a casing enclosing said motor including a metallic sidewall, a top wall and a bottom wall; and a housing comprising a quantity of initially flowable, cured synthetic resinous material surrounding said casing, said material in said solidified condition being an integral body of expanded, microcellular foam in firm, rigid, face-to-face engagement with at least said sidewalls of said casing along substantially the entire vertical and horizontal extent thereof, said casing extending substantially around the periphery of said motor and being normally substantially free of openings for generally precluding a contact of said material with said motor, said housing further including a fluid inlet and a fluid discharge passage communicating with said inlet, said motor having means operably coupled therewith for drawing fluid into said inlet and out said discharge passage, said discharge passage having an integrally molded outlet fitting at one end thereof presenting a threaded portion, and wherein said density of said expanded, microcellular foam material is greater in regions adjacent said threaded portion than the density of said foam material in other regions of said housing.

* * * * *